US012473801B2

(12) United States Patent
Shelton

(10) Patent No.: US 12,473,801 B2
(45) Date of Patent: Nov. 18, 2025

(54) BEARING-FREE SELF-POSITIONING PERFORATING GUN FOR WELLBORE OPERATIONS

(71) Applicant: HARRISON JET GUNS II, L.P., Kennedale, TX (US)

(72) Inventor: James F. Shelton, Kennedale, TX (US)

(73) Assignee: Harrison Jet Guns II, L.P., Kennedale, TX (US)

( * ) Notice: Subject to any disclaimer, the term of this patent is extended or adjusted under 35 U.S.C. 154(b) by 0 days.

(21) Appl. No.: 18/774,003

(22) Filed: Jul. 16, 2024

(65) Prior Publication Data

US 2025/0027389 A1 Jan. 23, 2025

Related U.S. Application Data

(60) Provisional application No. 63/547,745, filed on Nov. 8, 2023, provisional application No. 63/527,159, filed on Jul. 17, 2023.

(51) Int. Cl.

| | |
|---|---|
| ***E21B 43/117*** | (2006.01) |
| ***E21B 23/00*** | (2006.01) |
| ***E21B 43/119*** | (2006.01) |

(52) U.S. Cl.

CPC ..... *E21B 43/117* (2013.01); *E21B 43/119* (2013.01)

(58) Field of Classification Search

CPC .. E21B 43/117; E21B 43/119; E21B 43/1185; E21B 43/116; E21B 32/00; F24D 1/05

USPC ..... 166/55

See application file for complete search history.

(56) References Cited

U.S. PATENT DOCUMENTS

| | | | | |
|---|---|---|---|---|
| 2,821,136 | A * | 1/1958 | Castel | E21B 43/1185 175/4.55 |
| 2016/0356132 | A1* | 12/2016 | Burmeister | E21B 43/1185 |
| 2019/0085664 | A1* | 3/2019 | Hardesty | E21B 43/116 |
| 2020/0157924 | A1* | 5/2020 | Melhus | E21B 43/119 |
| 2020/0256168 | A1* | 8/2020 | Knight | E21B 43/117 |
| 2022/0258103 | A1* | 8/2022 | Eitschberger | F42B 3/10 |
| 2023/0069950 | A1* | 3/2023 | Badii | E21B 43/1185 |
| 2023/0203923 | A1* | 6/2023 | Eitschberger | E21B 43/116 |

* cited by examiner

*Primary Examiner* — Nicole Coy
*Assistant Examiner* — Douglas S Wood
(74) *Attorney, Agent, or Firm* — WARNER NORCROSS + JUDD LLP

(57) ABSTRACT

An improved perforating gun is provided. The perforating gun includes a shaped charge positioning tube that is freely rotatable with respect to an outer gun barrel without the use of bearings. The perforating gun includes first and second contact housings coupled to opposing ends of the shaped charge positioning tube. Each contact housing includes an electrical connector plug that is rotatable within a socket opening of a corresponding tandem, such that the electrical connector plugs define an axis of rotation of the shaped charge positioning tube. An asymmetric weight provides a desired angular orientation of the shaped charge positioning tube when inclined from vertical. The perforating gun further includes a grounding collar fixedly attached to the shaped charge positioning tube, with a plurality of resilient fingers extending radially therefrom in sliding engagement with the outer gun barrel.

25 Claims, 9 Drawing Sheets

BEARING-FREE SELF-POSITIONING PERFORATING GUN FOR WELLBORE OPERATIONS

CROSS-REFERENCE TO RELATED APPLICATIONS

This application claims the benefit of U.S. Provisional Application 63/547,745, filed Nov. 8, 2023, and U.S. Provisional Application 63/527,159, filed Jul. 17, 2023, the disclosures of which are incorporated by reference in their entirety.

TECHNICAL FIELD

The present invention relates to a self-positioning perforating gun having shaped charges to generate perforations through a wellbore casing.

BACKGROUND

In oil and gas operations, perforating guns are used to create perforations in a wellbore casing and surrounding rock formations. A gun string containing multiple perforating guns can be lowered into the wellbore on a wireline, slickline, or coiled tubing. Each perforating gun includes shaped charges that, when fired, are formed into high-velocity jets that penetrate the wellbore casing and create perforations in the surrounding rock.

Adjacent perforating guns are typically connected together using a threaded tandem. Threaded tandems include a short, externally threaded tube. A first perforating gun is threaded onto one end of the tandem, and a second perforating gun is threaded onto the other end of the tandem. This creates a secure and rigid connection between the two perforating guns, which allows them to be lowered into the wellbore as a single unit.

For inclined and horizontal wellbores, it is generally desirable to orient the shaped charges of the gun string vertically to better extract hydrocarbons from shale reservoirs. For example, it is known to use a weighted charge tube on bearings to orient shaped charges vertically in a perforating gun that is inclined or horizontally disposed. However, the use of bearings involves added complexity and cost. In addition, the charge tube may not be properly grounded, which can negatively impact the safety and efficacy of perforation operations.

Accordingly, there remains a continued need for an improved perforating gun for wellbore operations, particularly for inclined or horizontal wellbores.

SUMMARY OF THE INVENTION

An improved perforating gun is provided. The perforating gun includes a shaped charge positioning tube that is freely rotatable with respect to an outer gun barrel without the use of bearings. The perforating gun includes first and second contact housings coupled to opposing ends of the shaped charge positioning tube. Each contact housing includes an electrical connector plug that is rotatable within a socket opening of a corresponding tandem, such that the electrical connector plugs define an axis of rotation of the shaped charge positioning tube. An asymmetric weight provides a desired angular orientation of the shaped charge positioning tube when inclined from vertical. The perforating gun further includes a grounding collar fixedly attached to the shaped charge positioning tube, with a plurality of resilient fingers extending radially therefrom in sliding engagement with the outer gun barrel.

In one embodiment, the perforating gun includes first and second electrical connector plugs that are rotatable within a socket opening of a corresponding tandem. The electrical connector plugs can include a spring plunger or a banana pin-type connector having an outwardly bowed portion that is resiliently deformable. In these examples, all or a portion of the electrical connector plug is biased into contact with the socket opening, either axially as in the case of the spring plunger, or radially as in the case of the banana pin-type connector. Other connector plugs can be used in other embodiments, thereby providing a positive electrical connection for conveying a firing signal to the perforating gun.

In another embodiment, the perforating gun includes a first grounding collar adjacent the first contact housing and a second grounding collar adjacent the second contact housing. Each grounding collar includes a plurality of resilient fingers that are disposed in spaced apart intervals about an outer circumference of an arcuate band. The grounding collar extends around a portion of the shaped charge positioning tube opposite of the asymmetric weight. The resilient fingers span an annular gap between the shaped charge positioning tube and the outer gun barrel, such that the resilient fingers maintain sliding contact with the outer gun barrel regardless of the rotational position of the shaped charge positioning tube.

In another embodiment, the perforating gun includes an arming plunger. The arming plunger is seated within an axial opening in at least one of the first and second contact housings. The arming plunger is movable between a raised position and a lowered position, the arming plunger being spring-biased toward the raised position for creating an electrical connection to ground. The arming plunger includes a ground contact having a hemispherical tip for engaging a tapered opening in an adjacent tandem. The ground contact is press-fit within the arming collar and includes an exposed stem for attachment to a soldering wire. In a modification of this embodiment, the arming plunger can instead comprise a spring-biased grounding pin for engaging a tapered opening in an adjacent tandem. In these and other embodiments, the shaped charge positioning tube is freely rotatable with respect to the outer gun barrel, while the arming plunger or the spring-biased grounding pin maintains a secure connection to ground through 360-degrees of rotation of the shaped charge positioning tube.

These and other features and advantages of the present invention will become apparent from the following description of the invention, when viewed in accordance with the accompanying drawing and appended claims.

Before embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. In addition, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION

The following detailed description is merely exemplary in nature and is not intended to limit the oilfield perforating systems and methods as described herein. Furthermore, there is no intention to be bound by any theory presented in the preceding background or the following detailed description. The description is not in any way meant to limit the scope of any present or subsequent related claims.

As used here, the terms "above" and "below"; "up" and "down"; "upper" and "lower"; "upwardly" and "downwardly"; and other like terms indicating relative positions above or below a given point or element are used in this description to more clearly describe some embodiments. However, when applied to equipment and methods for use in wells that are deviated or horizontal, such terms may refer to a left to right, right to left, or diagonal relationship as appropriate.

Figure 1:
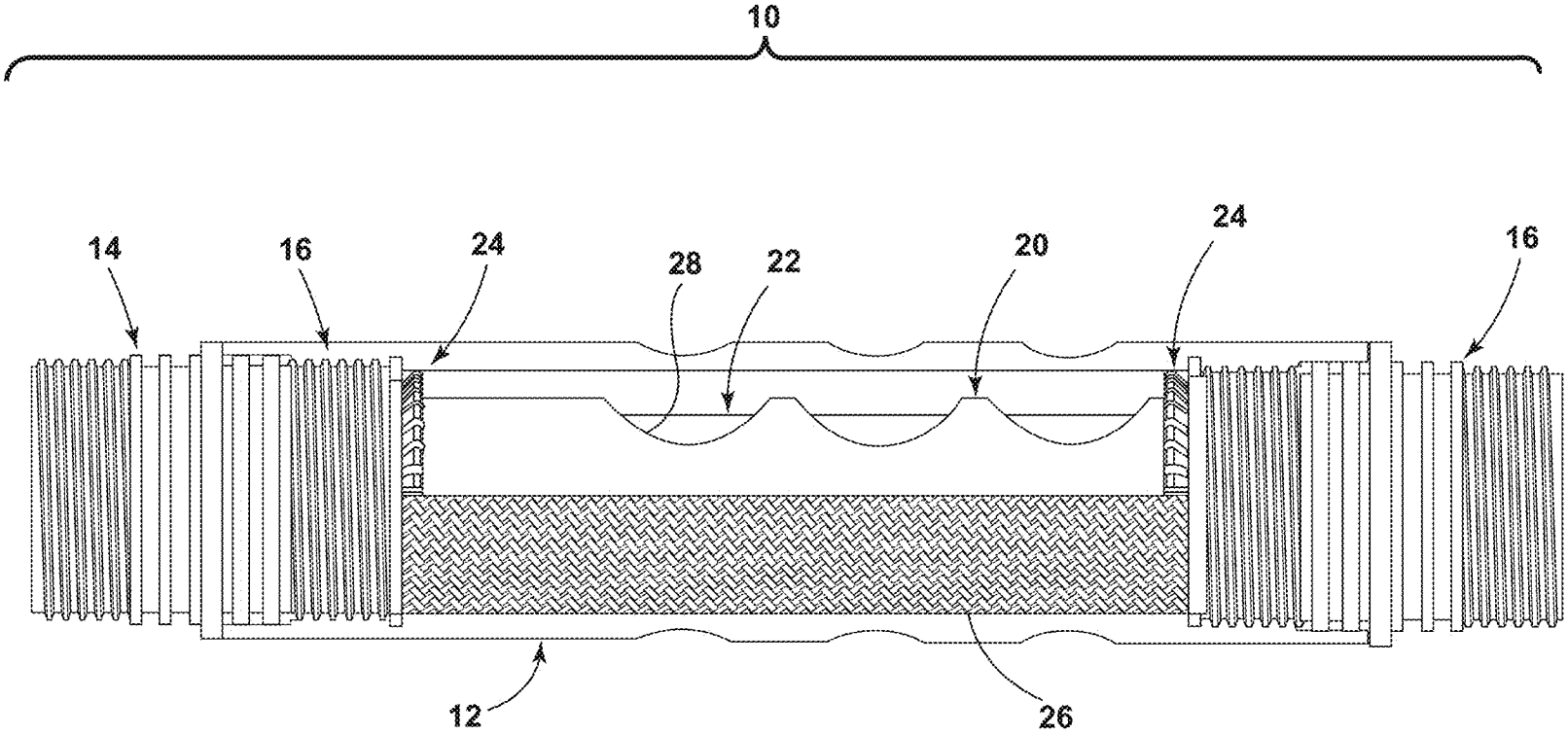
FIG. 1 is a partial cross-sectional view of a perforating gun in accordance with a first embodiment of the present invention.

Referring now to FIG. 1, a perforating gun system in accordance with one embodiment is illustrated and generally designated 10. The perforating gun system 10 includes a perforating gun 12 and at least one tandem, with two tandems 14, 16 shown in the FIG. 1. The perforating gun 12 includes an outer gun barrel 18, an internal shaped charge positioning tube 20, a plurality of shaped charges 22, at least one grounding collar 24, and an asymmetrical weight 26, each being discussed below.

The outer gun barrel 18 includes opposing box ends, and each tandem 14, 16 is threaded to a box end of the outer gun barrel 18 so that two or more perforating guns can be joined in series in a gun string. The outer gun barrel 18 is cylindrical and includes a length that is greater than the length of the shaped charge positioning tube 20, such that the outer gun barrel 18 extends beyond the shaped charge positioning tube 20 as shown in FIG. 1. In addition, the outer gun barrel 18 includes an inner diameter that is greater than an outer diameter of the shaped charge positioning tube 20, such that an annular gap is present between the outer gun barrel 18 and the shaped charge positioning tube 20 along its length.

The shaped charge positioning tube 20 includes a cylindrical body having multiple shaped charge openings 28 that receive a corresponding number of shaped charges 22. The openings 28 are axially aligned with each other in the illustrated embodiment but can be angularly offset from each other in other embodiments. The shaped charge positioning tube 20 includes three shaped charge openings in the illustrated embodiment, while other embodiments the shaped charge positioning tube 20 can include greater or fewer openings.

The outer gun barrel 18 and the shaped charge positioning tube 20 are generally formed from an electrically conductive material, for example stainless steel. The grounding collar 24 directly engages the outer gun barrel 18 and the shaped charge positioning tube 20, creating a secure ground connection. The asymmetrical weight 26 is attached to the shaped charge positioning tube 20, opposite of the shaped charge openings 28, to achieve a desired angular orientation of the shaped charges 22 when the perforating gun 12 is inclined at least 15 degrees from vertical within a wellbore. The action of gravity on the freely rotating shaped charge positioning tube 20 causes the tube 20 to orient itself in the most stable position, with the charges oriented vertically (in the case of the perforating gun being horizontal).

Figure 2:
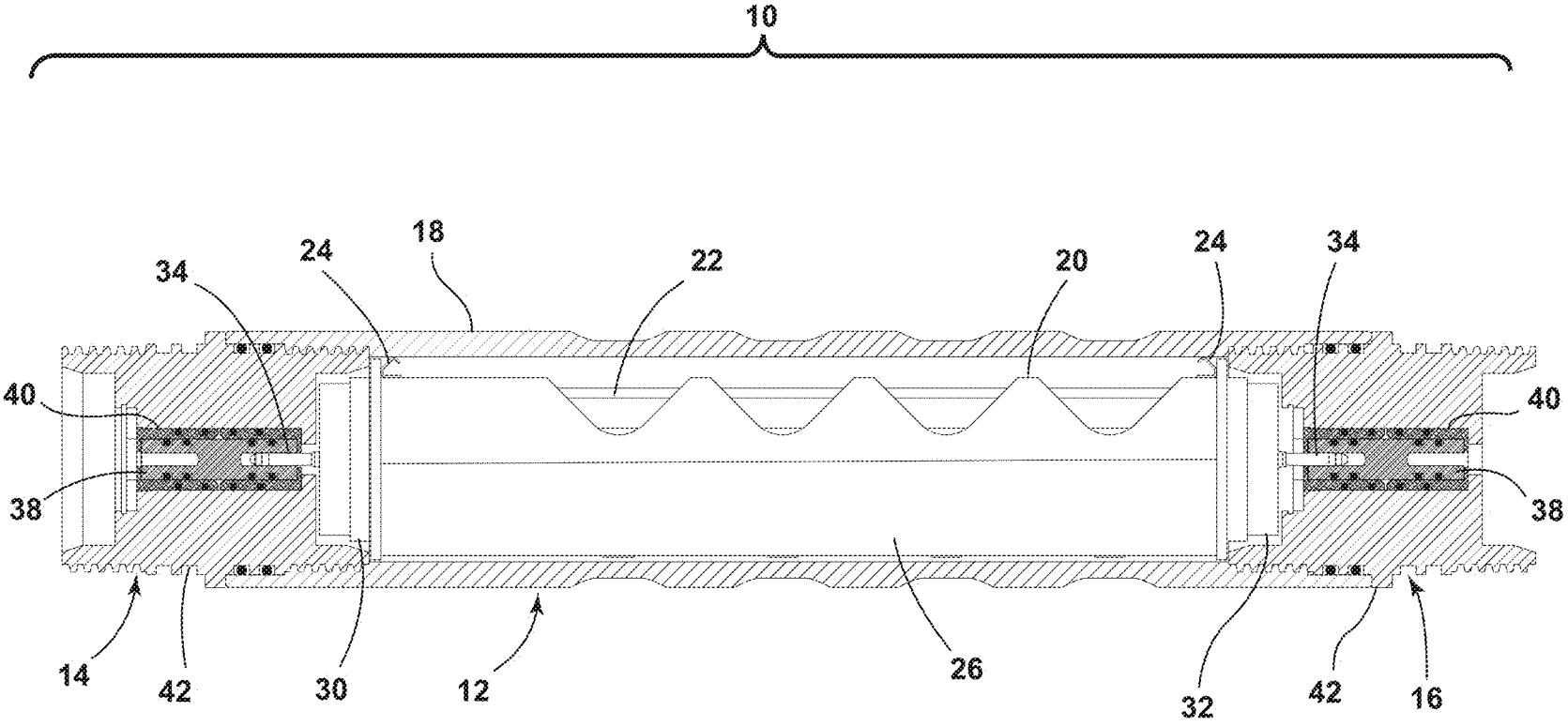
FIG. 2 is a cross-sectional view of the perforating gun of FIG. 1 including first and second banana pin connectors to engage first and second tandems.
Figure 3:
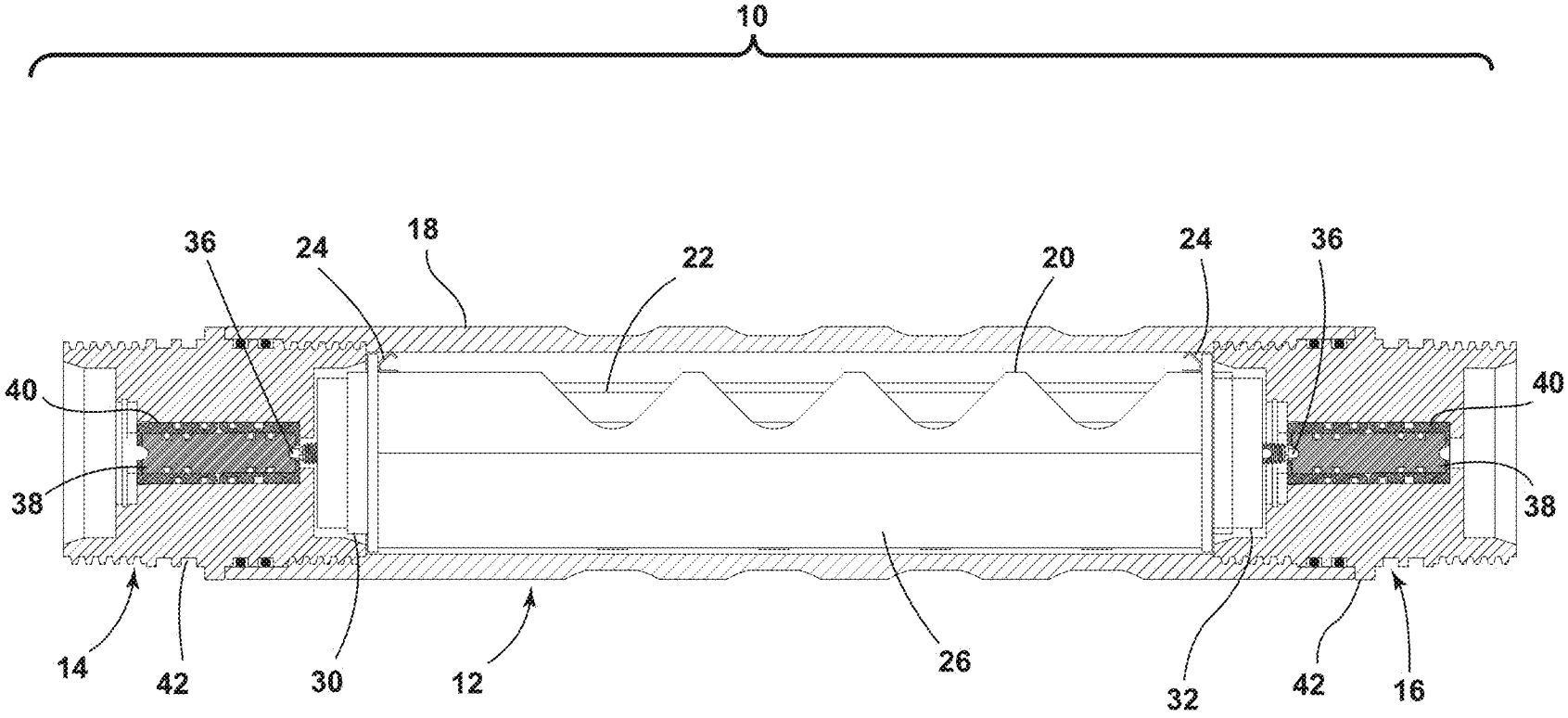
FIG. 3 is a cross-sectional view of the perforating gun of FIG. 1 including first and second spring plungers to engage first and second tandems.

As shown in FIGS. 2 and 3, the perforating gun 12 also includes a first contact housing 30 and a second contact housing 32. Each contact housing 30, 32 is formed from an electrically insulating material, for example molded plastic. In addition, each contact housing 30, 32 is partially received within opposing ends of the shaped charge positioning tube 20.

Each contact housing 30, 32 also includes an electrical connector plug protruding axially. With reference to FIG. 2, the electrical connector plug is a banana pin connector plug 34 having an outwardly bowed stem that is resiliently deformable. When received within a socket opening, the outwardly bowed stem compresses radially inward and bears against the socket opening by interference fit, thereby providing a positive mechanical and electrical connection, while also being rotatable within the socket opening. As alternatively shown in FIG. 3, the electrical connector plug can include a spring plunger 36 that is spring-biased into a shallow socket opening in the tandem. The spring plunger 36 provides a positive mechanical and electrical connection, while also being rotatable within the socket opening.

Figure 4:
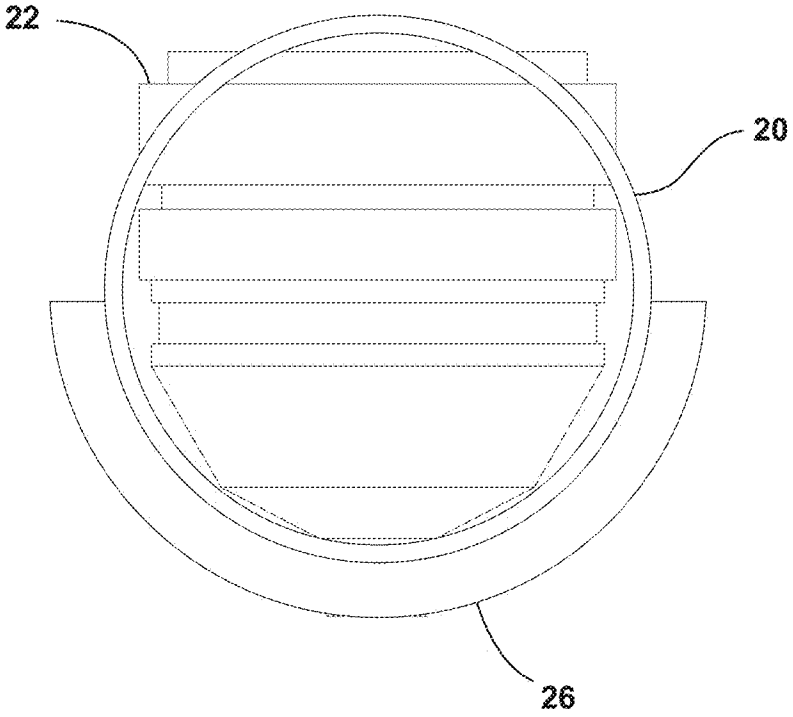
FIG. 4 is an end-view of a shaped charge positioning tube having an asymmetric weight and at least one shaped charge.

As also shown in FIGS. 2-3, each tandem 14, 16 includes a solid anodized pass-through element 38. The pass-through element 38 is surrounded by an insulating sleeve 40 that is received within a cylindrical opening in the tandem 14, 16. The insulating sleeve 40 is formed from a non-conductive material to electrically isolate the pass-through element 38 from the tandem body 42, which is electrically grounded. The outer surface of the insulating sleeve includes at least one O-ring to create a seal with the cylindrical opening the tandem. In operation, the firing signal passes through the pass-through element 38 to the electrical connector plug 34 or 36 of the perforating gun 12. The electrical connector plug 34 or 36 is in electrical communication with an addressable switch (not shown). Wires extend from the addressable switch and travel to a detonator for firing each of the shaped charges 22 generally vertically, through the outer gun casing 18, as generally shown in FIG. 4.

For the embodiments shown, electrical connectivity to the addressable switch is established through the rotatable electrical connector plug 34 or 36. The electrical connector plug 34 or 36 serves a dual function as (1) an axis of rotation for the weighted shaped charge positioning tube and (2) an electrical connector. The firing current for the addressable switch is supplied from the upwell gun via the electrical connector plug. The electrical ground for the perforating gun 12 is achieved through connection of the grounding collar 24 to the outer gun barrel 18 and the shaped charge positioning tube 20.

Figure 5:
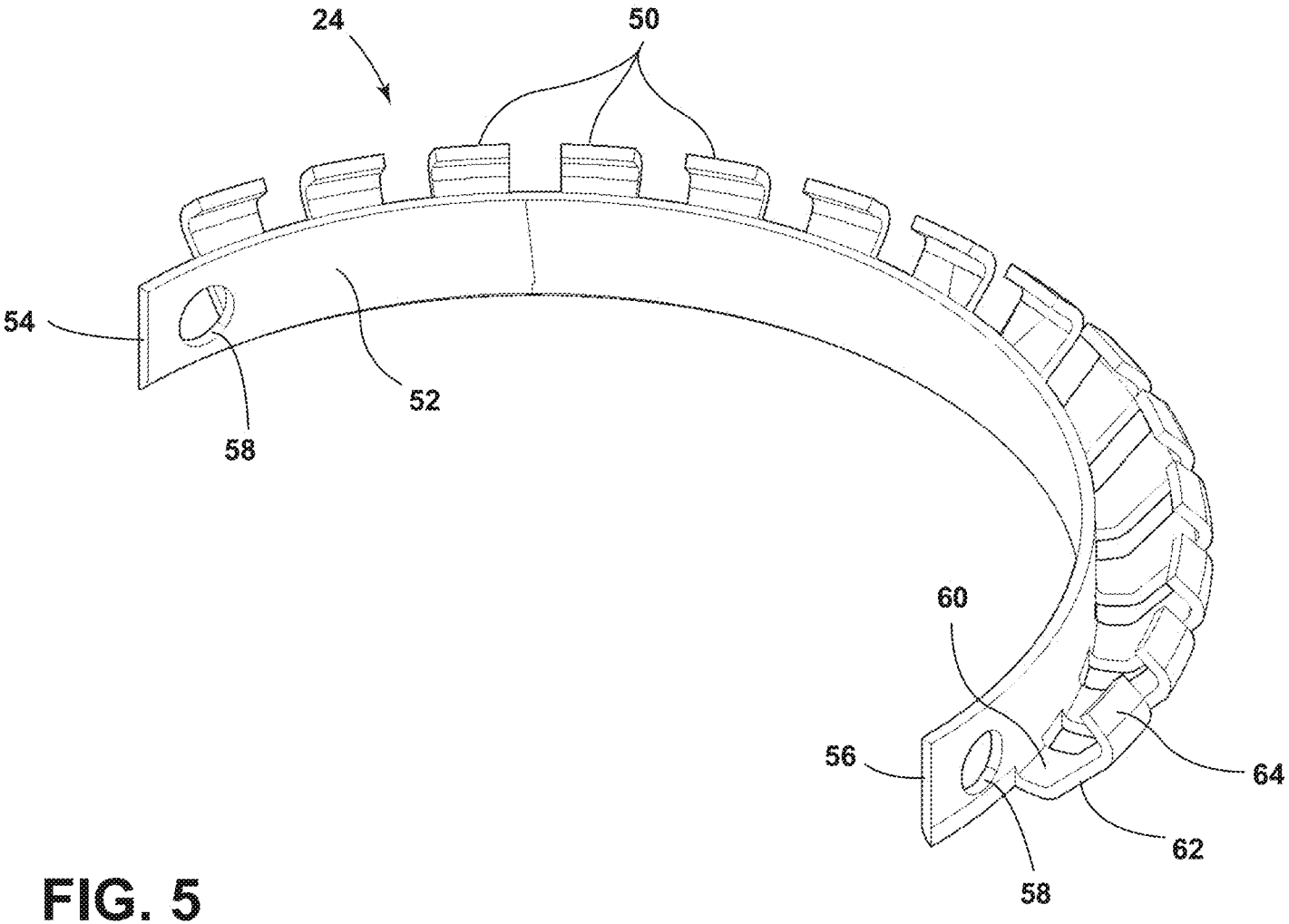
FIG. 5 is a perspective view of a grounding collar for the perforating gun of FIG. 1.

Turning now to FIG. 5, the grounding collar 24 includes a plurality of resilient fingers 50 that are integrally joined to an arcuate band 52 that partially or completely encircles the shaped charge positioning tube 20. The band 52 spans 180-degrees of an arc of a circle in the illustrated embodiment, but can be configured differently in other embodiments, for example 90-degrees or 60-degrees. The band 52 includes first and second terminal end portions 54, 56 that abut the asymmetric weight 26. In addition, the arcuate band 52 includes fastener apertures 58 adjacent the end portions 54, 56 to allow the collar 24 to be secured to the shaped charge positioning tube 20, such that the grounding collar 24 rotates in unison with the shaped charge positioning tube 20 while maintaining contact with the outer gun barrel 18.

The grounding collar 24 is generally formed from an electrically conductive material, for example stainless steel. The plurality of resilient fingers 50 are spaced apart from each other in fixed intervals about the circumference of the arcuate band 52, with fourteen resilient fingers being shown in the illustrated embodiment, by non-limiting example. Each resilient finger 50 extends radially outward from the arcuate band and includes a first planar segment 60, a second planar segment 62, and a third planar segment 64 that are angled relative to each other. The resilient fingers 50 are J-shaped and curl inward, such that the outermost radial surface of the resilient fingers 50 (where the second segment 62 and the third segment 64 meet) can bear against the inner diameter of the outer gun barrel 18. The grounding collar 24 is rigidly or fixedly attached to the shaped charge positioning tube 20 but freely rotatable relative to the outer gun barrel 18, such that the shaped charge positioning tube 20 maintains a secure electrical connection to ground regardless of the orientation of the perforating gun 12.

In operation, the firing signal is passed through the first tandem 14 (via the pass-through element 38) to the perforating gun 12. The firing signal then passes from the first electrical connector plug to the second electrical connector plug for connection to a second perforating gun in the gun string. The firing signal is also passed to an addressable switch within the first or second contact housing 30, 32. Wires extend from the addressable switch and travel to a detonator in the perforating gun 12. The perforating gun assembly 10 is then lowered into a wellbore having a wellbore casing, optionally as part of a gun string, and a firing signal causes shaped charges 22 within the perforating guns to detonate, creating a plurality of vertically oriented perforations through the wellbore casing without the use of bearings, which as noted above involve added complexity and cost.

Figure 6:
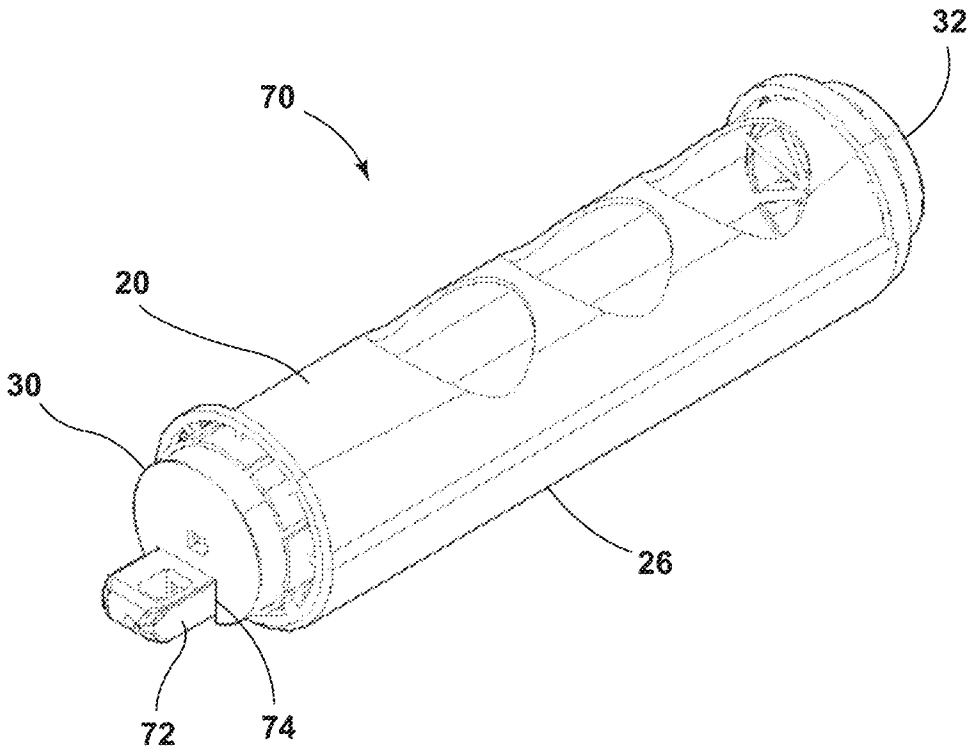
FIG. 6 is a perspective view of a shaped charge positioning tube for a perforating gun in accordance with a second embodiment of the present invention.
Figure 7:
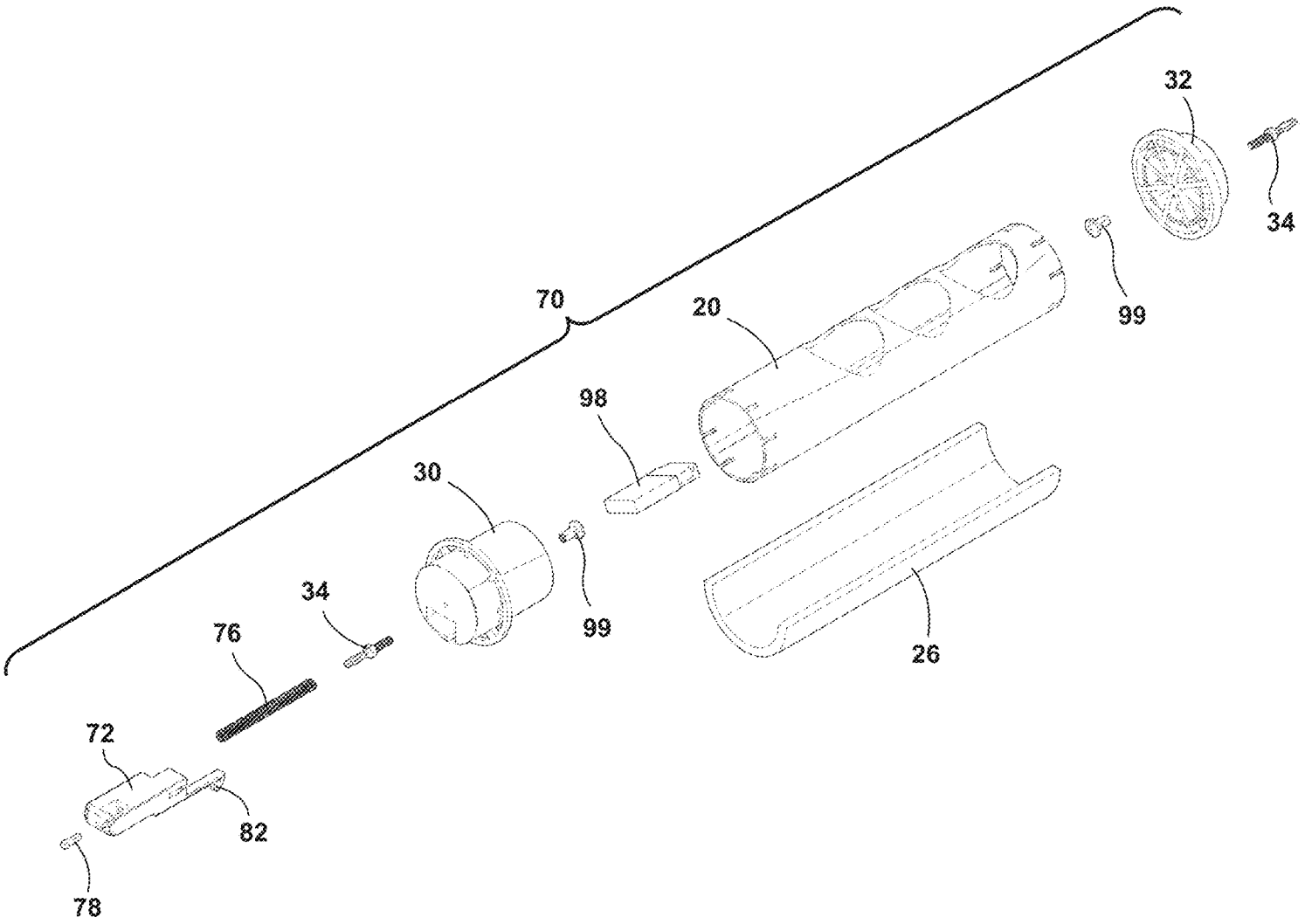
FIG. 7 is an exploded view of the shaped charge positioning tube of FIG. 6 including an arming plunger having a ground contact.

Referring now to FIGS. 6-7, a perforating gun system in accordance with a further embodiment is illustrated and generally designated 70. The perforating gun system of FIGS. 6-7 is structurally and functionally similar to the perforating gun system of FIG. 1, except that the uphole contact housing 30, and optionally the downhole contact housing 32, includes a spring-biased arming plunger 72 for providing a secure connection to ground, rather than the grounding collar 24 of FIG. 5. In particular, the uphole contact housing 30 includes a rectangular axial opening 74 for the arming plunger 72, the arming plunger 72 being radially offset from the centrally-disposed electrical connector plug 34. The arming plunger 72 moves within the axial opening 74 between a raised (extended) position and a lowered (seated) position. The arming plunger 72 is biased in the raised position by a helical compression spring 76. A metal ground contact 78 protrudes from the arming plunger 72 for creating an electrical connection to ground when engaged with the adjacent tandem 14.

Figure 8:
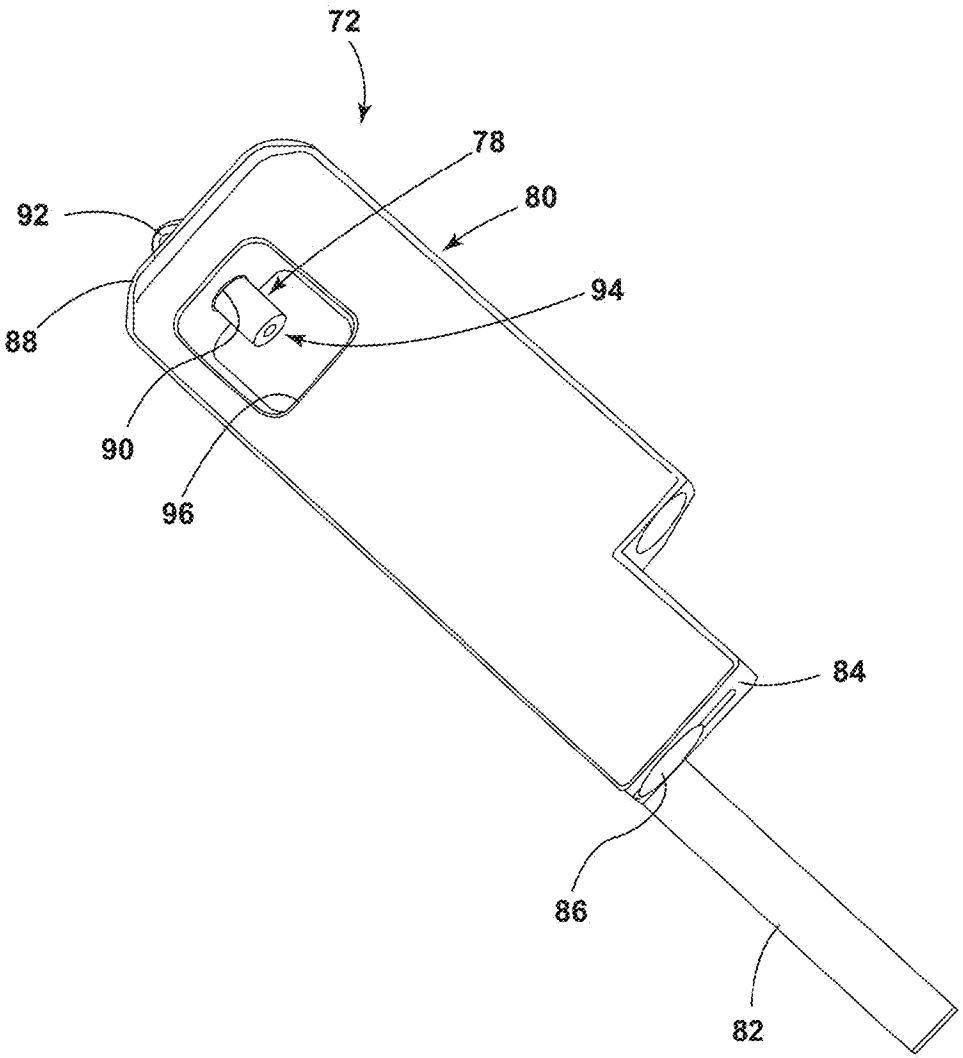
FIG. 8 is a perspective view of an arming plunger for use with the shaped charge positioning tube of FIGS. 6-7.

As more specifically shown in FIG. 8, the arming plunger 72 includes a non-conductive body 80 having a latching arm 82 for limiting vertical travel of the arming plunger 72. The proximal end 84 of the arming plunger 72 includes an axial opening 86 for the compression spring 76, the compressing spring 76 functioning to bias the arming plunger 72 into the raised position. The distal end 88 of the arming plunger 72 includes an axial opening 90 for the metal ground contact 78. The metal ground contact 78 is press-fit into the axial opening 90 and includes a hemispherical tip 92 for engaging a conical grounding surfacing in the uphole tandem 14, such that the arming plunger 72 can provide a secure connection to ground through 360-degrees of rotation of the shaped charge positioning tube 20 within the outer gun barrel 18. The stem-like base 94 of the metal ground contact 78 protrudes into an aperture 96 in the arming plunger body 80, such that a grounding wire can be soldered to the metal ground contact 78. The perforating gun system 80 is otherwise structurally and functionally similar to the perforating gun system 10 of FIG. 1, with the additional depiction of an addressable switch 98 (contained within the uphole contact housing 30) which is responsive to a firing signal from the contact pin 34. The perforating gun system also includes first and second communication pin retainers 99 for threadably engaging the base of the corresponding first and second contact pins 34.

Figure 9:
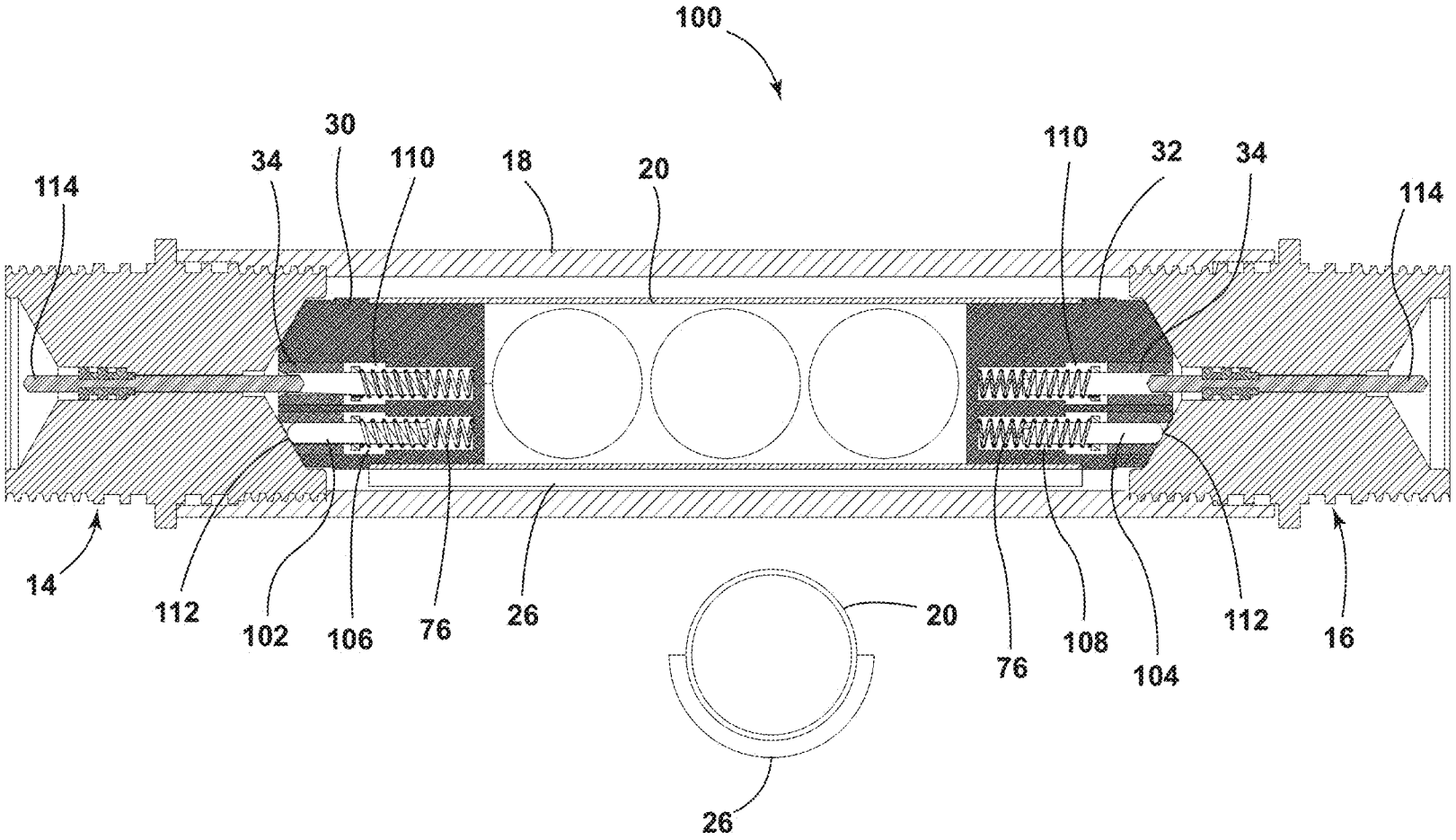
FIG. 9 is a cross-sectional view of a perforating gun in accordance with a third embodiment of the invention.

Referring now to FIG. 9, a further embodiment is illustrated and generally designated 100. The perforating gun system of FIG. 9 is structurally and functionally similar to the perforating gun system of FIGS. 6-8, except that the uphole contact housing 30 and the downhole contact housing 32 include a spring-biased grounding pin 102, 104 for providing a secure connection to ground, rather than the arming plunger 72 of FIG. 8. In particular, each spring-biased grounding pin 102, 104 is seated within an axial opening 106, 108 within the respective contact housing 30, 32. The axial opening 106, 108 is radially offset from a central opening 110 for a communication pins 34. Each spring-biased grounding pin 106, 108 includes a hemispherical tip 112 for engaging the conical opening in the adjacent tandem 14, 16, such that the grounding pins 102, 104 provide a secure connection to ground through 360-degrees of rotation of the shaped charge positioning tube 20 within the outer gun barrel 18. The communication pins 34 are also spring-biased for receiving a firing signal from the adjacent perforating gun in a gun string via a pass-through element 114.

The above description is that of current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

What is claimed is:

1. A perforating gun comprising:

an outer gun barrel including a cylindrical sidewall having an inner surface;

a shaped charge positioning tube received within the outer gun barrel, the shaped charge positioning tube having an outer surface that is spaced apart from the inner surface of the outer gun barrel such that an annular gap exists therebetween;

first and second contact housings coupled to opposing ends of the shaped charge positioning tube and including respective first and second electrical connector plugs protruding axially therefrom;

a plurality of shaped charges that are supportably received within the shaped charge positioning tube; and a grounding collar disposed between the shaped charge positioning tube and the outer gun barrel for creating an electrical connection to ground, wherein the shaped charge positioning tube is freely rotatable with respect to the outer gun barrel, the shaped charge positioning tube including an asymmetric weight for achieving a desired angular orientation of the plurality of shaped charges when the perforating gun is inclined from vertical, wherein the grounding collar is fixedly attached to the shaped charge positioning tube and is in sliding engagement with the outer gun barrel.

2. The perforating gun of claim 1, wherein the grounding collar includes a plurality of resilient fingers extending radially outward therefrom for engaging the inner surface of the outer gun barrel.

3. The perforating gun of claim 2, wherein each of the plurality of resilient fingers are disposed in fixed intervals about an outer circumference of the grounding collar.

4. The perforating gun of claim 2, wherein the grounding collar extends around a portion of the shaped charge positioning tube opposite of the asymmetric weight.

5. The perforating gun of claim 1, wherein the grounding collar is a first grounding collar adjacent the first contact housing, further including a second grounding collar adjacent the second contact housing.

6. The perforating gun of claim 1, wherein the first and second electrical connector plugs include an outwardly bowed portion that is resiliently deformable.

7. The perforating gun of claim 1, wherein the first and second electrical connector plugs include a spring plunger.

8. The perforating gun of claim 1, wherein the plurality of shaped charges are axially aligned with each other within the shaped charge positioning tube.

9. The perforating gun of claim 1, wherein the first and second contact housings are formed from an electrically insulating material.

10. A perforating gun comprising:

a shaped charge positioning tube concentrically received within an outer gun barrel, the shaped charge positioning tube being freely rotatable with respect to the outer gun barrel;

first and second contact housings coupled to opposing ends of the shaped charge positioning tube and including respective first and second electrical connector plugs protruding axially therefrom for engaging first and second tandems, respectively;

a grounding collar disposed between the shaped charge positioning tube and the outer gun barrel for creating an electrical connection to ground, wherein the grounding collar is fixedly attached to the shaped charge positioning tube and includes a plurality of resilient fingers extending radially therefrom in sliding engagement with the outer gun barrel; and an asymmetric weight coupled to the shaped charge positioning tube for achieving a desired angular orientation of the shaped charge positioning tube when inclined from vertical;

wherein the grounding collar extends around a portion of the shaped charge positioning tube opposite of the asymmetric weight.

11. The perforating gun of claim 10, wherein each of the plurality of resilient fingers are disposed in fixed intervals about an outer circumference of the grounding collar.

12. The perforating gun of claim 10, wherein the grounding collar is a first grounding collar adjacent the first contact housing, further including a second grounding collar adjacent the second contact housing.

13. The perforating gun of claim 10, wherein the first and second electrical connector plugs define an axis of rotation of the shaped charge positioning tube.

14. The perforating gun of claim 10, wherein the first and second electrical connector plugs are rotatable within socket openings in the first and second tandems, respectively.

15. The perforating gun of claim 10, further including a plurality of shaped charges within respective ones of a plurality of openings in the shaped charge positioning tube.

16. The perforating gun of claim 10, wherein the plurality of shaped charges openings are axially aligned with each other opposite of the asymmetric weight.

17. A perforating gun comprising:

a shaped charge positioning tube concentrically received within an outer gun barrel, the shaped charge positioning tube being freely rotatable with respect to the outer gun barrel;

first and second contact housings coupled to opposing ends of the shaped charge positioning tube and including respective first and second electrical connector plugs protruding axially therefrom for engaging first and second tandems, respectively;

a grounding collar disposed between the shaped charge positioning tube and the outer gun barrel for creating an electrical connection to ground, wherein the grounding collar is fixedly attached to the shaped charge positioning tube and includes a plurality of resilient fingers extending radially therefrom in sliding engagement with the outer gun barrel; and an asymmetric weight coupled to the shaped charge positioning tube for achieving a desired angular orientation of the shaped charge positioning tube when inclined from vertical, wherein the first and second electrical connector plugs are formed from an electrically conductive material and include an outwardly bowed stem portion that is resiliently deformable, such that the outwardly bowed stem portion compresses radially inward when inserted into a socket opening in the first and second tandems.

18. A perforating gun comprising:

a shaped charge positioning tube concentrically received within an outer gun barrel, the shaped charge positioning tube being freely rotatable with respect to the outer gun barrel;

first and second contact housings coupled to opposing ends of the shaped charge positioning tube and including respective first and second electrical connector plugs protruding axially therefrom for engaging first and second tandems, respectively;

a grounding collar disposed between the shaped charge positioning tube and the outer gun barrel for creating an electrical connection to ground, wherein the grounding collar is fixedly attached to the shaped charge positioning tube and includes a plurality of resilient fingers extending radially therefrom in sliding engagement with the outer gun barrel; and an asymmetric weight coupled to the shaped charge positioning tube for achieving a desired angular orientation of the shaped charge positioning tube when inclined from vertical, wherein the first and second electrical connector plugs include a spring plunger that is spring-biased into a socket opening in the first and second tandems, the spring plunger being rotatable in the socket opening.

19. A perforating gun comprising:

an outer gun barrel including a cylindrical sidewall having an inner surface;

a shaped charge positioning tube received within the outer gun barrel, the shaped charge positioning tube having an outer surface that is spaced apart from the inner surface of the outer gun barrel such that an annular gap exists therebetween;

first and second contact housings coupled to opposing ends of the shaped charge positioning tube and including respective first and second communication pins protruding axially therefrom; and an arming plunger within an axial opening in at least one of the first and second contact housings, the arming plunger being movable between a raised position and a lowered position, the arming plunger being spring-biased in the raised position for creating an electrical connection to ground, wherein the shaped charge positioning tube is freely rotatable with respect to the outer gun barrel, the shaped charge positioning tube including an asymmetric weight for achieving a desired angular orientation when the perforating gun is inclined from vertical;

wherein the arming plunger includes a ground contact protruding therefrom; and wherein the ground contact is press-fit within an opening in the arming plunger.

20. The perforating gun of claim 19, wherein the arming plunger is laterally offset from the first and second communication pins.

21. The perforating gun of claim 19, wherein the arming plunger includes a flexible latching arm for limiting axial travel of the arming plunger in the raised position.

22. The perforating gun of claim 19, wherein the ground contact includes a stem that protrudes into an aperture in the arming plunger for attachment to a soldering wire.

23. A perforating gun comprising:

an outer gun barrel including a cylindrical sidewall having an inner surface;

a shaped charge positioning tube received within the outer gun barrel, the shaped charge positioning tube having an outer surface that is spaced apart from the inner surface of the outer gun barrel such that an annular gap exists therebetween;

first and second contact housings coupled to opposing ends of the shaped charge positioning tube and including respective first and second communication pins protruding axially therefrom; and first and second spring-biased grounding pins within an axial opening in respective ones of the first and second contact housings, the first and second spring-biased grounding pins being radially offset from the first and second communication pins, wherein the shaped charge positioning tube is freely rotatable with respect to the outer gun barrel, the shaped charge positioning tube including an asymmetric weight for achieving a desired angular orientation when the perforating gun is inclined from vertical;

wherein the first and second spring-biased contact pins include a hemispherical tip for engaging a conical surface of an adjacent tandem.

24. The perforating gun of claim 23, wherein the first and second contact housings are formed from an electrically insulating material.

25. The perforating gun of claim 23, further including a compression spring received within an axial opening for biasing the grounding pins axially outward.

* * * * *